US011206875B2

(12) United States Patent
Morrow Contreras

(10) Patent No.: US 11,206,875 B2
(45) Date of Patent: Dec. 28, 2021

(54) BREAST ADHESIVE

(71) Applicant: Christina Morrow Contreras, Vallejo, CA (US)

(72) Inventor: Christina Morrow Contreras, Vallejo, CA (US)

( * ) Notice: Subject to any disclaimer, the term of this patent is extended or adjusted under 35 U.S.C. 154(b) by 48 days.

(21) Appl. No.: 16/683,818

(22) Filed: Nov. 14, 2019

(65) Prior Publication Data

US 2021/0145083 A1 May 20, 2021

(51) Int. Cl.
*A41C 3/14* (2006.01)
*A41C 3/06* (2006.01)

(52) U.S. Cl.
CPC ..... *A41C 3/144* (2013.01); *A41C 3/065* (2013.01)

(58) Field of Classification Search
CPC A41C 3/065; A41C 3/144; A41C 3/04; A61F 13/145; A61F 13/02; A61F 13/0259; A61F 2013/00165; A61J 13/00; A41D 13/0518
USPC ..... 450/91, 37, 57
See application file for complete search history.

(56) References Cited

U.S. PATENT DOCUMENTS 2,163,792 A * 6/1939 Littlehales ..... A61J 13/00 606/201
2,221,758 A * 11/1940 Elmquist ..... A61F 13/00021 128/888
2,596,567 A * 5/1952 Langs ..... A41C 3/065 450/81
2,869,553 A * 1/1959 Nicl ..... A41C 3/065 450/81
3,280,818 A * 10/1966 Pankey ..... A41C 3/065 450/81
3,749,102 A * 7/1973 Wynants ..... A41C 3/065 450/81
3,840,012 A * 10/1974 Rushton, Jr. ..... A61M 1/062 604/346
3,934,593 A * 1/1976 Mellinger ..... A41C 3/065 450/56
4,270,538 A * 6/1981 Murphy ..... A61M 1/064 450/37
4,333,471 A * 6/1982 Nakai ..... A61F 13/145 128/890
4,640,288 A * 2/1987 Hattori ..... A41C 3/065 450/81
4,754,750 A * 7/1988 Imonti ..... A61F 13/145 128/888

(Continued)

*Primary Examiner* — Jocelyn Bravo
(74) *Attorney, Agent, or Firm* — Argus Intellectual Enterprise; Jordan Sworen; Daniel Enea

(57) ABSTRACT

An adhesive for securing a nipple shield to a breast. The breast adhesive includes a flexible member, having a front side and a rear side, wherein the rear side can secure to both a breast and a nipple shield simultaneously. The flexible member includes U-shape with a first end and a second end disposed opposite one another, such that the first end and the second end are symmetrical about a vertical axis. An outer perimeter of the flexible member includes a plurality of curved flanges therealong that adhere to a user's breast. In operation, an inner perimeter of the flexible member is positioned interior to an outer perimeter of the nipple shield and the outer perimeter of the flexible member is to be positioned exterior to the outer perimeter of the nipple shield. In this way, the nipple shield is secured to a mother while breastfeeding.

8 Claims, 3 Drawing Sheets

(56) References Cited

U.S. PATENT DOCUMENTS 4,870,977 A * 10/1989 Imonti ..... A61F 15/008 128/890
4,992,074 A * 2/1991 Diaz ..... A41C 3/065 2/267
D338,771 S * 8/1993 Xanthakis ..... D2/706
5,423,783 A * 6/1995 Battles ..... D04H 1/54 604/344
5,514,166 A * 5/1996 Silver ..... A61M 1/062 604/74
5,562,107 A * 10/1996 Lavender ..... A61F 13/0269 128/888
5,690,536 A * 11/1997 Madden ..... A61F 13/141 2/267
5,755,611 A * 5/1998 Noble ..... A41C 3/065 450/39
5,782,672 A * 7/1998 Woodley ..... A41C 3/065 2/267
5,919,180 A * 7/1999 Raimondo ..... A61F 13/141 604/387
5,998,693 A * 12/1999 Zagame ..... A61F 13/145 602/52
6,039,629 A * 3/2000 Mitchell ..... A61F 13/141 2/267
6,074,272 A * 6/2000 Hebert ..... A61F 13/141 450/37
6,200,195 B1 * 3/2001 Furuno ..... A41C 3/065 450/81
6,241,715 B1 * 6/2001 Houser ..... A61F 7/02 450/37
6,338,665 B1 * 1/2002 Dawson ..... A41C 3/065 450/37
6,350,175 B2 * 2/2002 Johnson ..... A41C 3/065 450/57
6,659,841 B2 * 12/2003 Raimondo ..... A41C 3/04 450/36
6,669,064 B2 * 12/2003 Perricone ..... A61J 9/001 215/11.3
6,685,682 B1 * 2/2004 Heinecke ..... A61F 13/023 602/41
6,726,791 B1 * 4/2004 Øelund ..... A61F 13/0226 156/199
6,761,614 B2 * 7/2004 Pinna ..... A41C 3/065 450/41
D497,996 S * 11/2004 Rodriguez ..... D2/706
6,857,935 B1 * 2/2005 Dohan ..... A41C 3/065 2/244
6,962,519 B1 * 11/2005 Clark ..... A61J 13/00 450/37
7,001,241 B2 * 2/2006 Gorringe ..... A61F 13/141 450/37
7,152,606 B1 * 12/2006 Schindler ..... A41C 3/065 128/889
7,163,433 B2 * 1/2007 Chou ..... A41C 3/065 2/267
7,175,502 B2 * 2/2007 Clark ..... A61J 13/00 128/889
7,229,335 B2 * 6/2007 Davis ..... A41C 3/065 450/54
7,399,216 B2 * 7/2008 Mateo ..... A41C 3/065 450/1
7,404,752 B1 * 7/2008 Karon ..... A41C 3/12 2/53
D575,927 S * 9/2008 Valentin ..... D2/706
D584,399 S * 1/2009 Pacini ..... D24/109
7,473,158 B2 * 1/2009 Horton ..... A61K 9/7007 450/1
D590,577 S * 4/2009 Bruno ..... D2/853
7,662,018 B1 * 2/2010 Thompson ..... A61J 13/00 450/37
7,811,248 B2 10/2010 Bjorge
D629,589 S * 12/2010 Mayo ..... D2/853
7,905,763 B1 * 3/2011 Frank ..... A61F 13/141 450/37
7,921,851 B2 * 4/2011 Kurz ..... A61F 13/141 128/889
7,938,122 B2 * 5/2011 Clark ..... A61F 2/52 128/890
7,950,980 B2 * 5/2011 Solberg ..... A61M 1/062 450/36
8,038,660 B2 * 10/2011 Bruce ..... A61F 13/141 604/346
8,118,639 B1 * 2/2012 Boon ..... A41C 3/144 450/37
8,172,874 B2 * 5/2012 Randolph ..... A61J 11/006 606/236
D672,939 S * 12/2012 Jacquart ..... D2/882
8,469,771 B2 * 6/2013 Francis ..... A61J 13/00 450/37
8,480,451 B2 * 7/2013 Solberg ..... A61M 1/064 450/37
8,668,550 B1 * 3/2014 Sartell ..... A41C 3/12 450/81
D704,266 S * 5/2014 Ettinger ..... D20/18
9,254,188 B2 * 2/2016 Dempsey ..... A61F 2/12
9,517,183 B2 * 12/2016 Ward ..... A61J 13/00
9,561,136 B2 * 2/2017 Williams ..... A61F 13/0243
9,596,891 B2 * 3/2017 Deal ..... A41C 3/0007
9,706,797 B1 * 7/2017 Kratsa ..... A41C 3/065
D809,148 S * 1/2018 Takeda ..... D24/189
D810,924 S * 2/2018 Emmenegger ..... D24/109
9,895,292 B1 * 2/2018 Tronson ..... A61J 11/0005
10,016,341 B2 7/2018 Chin et al.
10,136,682 B1 * 11/2018 Marcella ..... A61F 7/02
10,159,549 B1 * 12/2018 Horrigan ..... A61D 9/00
10,456,497 B2 * 10/2019 Howell ..... A61M 25/02
10,568,785 B2 * 2/2020 Moser ..... A61B 46/23
10,638,799 B2 * 5/2020 Karon ..... A41C 3/065
10,660,377 B2 * 5/2020 Randall ..... A41C 3/0007
D906,629 S * 1/2021 Gelder ..... D2/641
D907,328 S * 1/2021 Zhao ..... D2/706
10,925,719 B2 * 2/2021 Kaplan ..... A61F 2/12
2001/0049250 A1 * 12/2001 Johnson ..... A41C 3/065 450/81
2002/0082540 A1 * 6/2002 Johnston ..... A61F 13/00068 602/48
2003/0125680 A1 * 7/2003 Ding ..... A61F 13/0203 604/304
2004/0157528 A1 * 8/2004 Tsai ..... A41C 3/144 450/57
2004/0192164 A1 * 9/2004 Ajili ..... A41C 3/065 450/38
2005/0164602 A1 * 7/2005 Armstrong ..... A41C 3/0057 450/57
2005/0186885 A1 * 8/2005 Valentin ..... A41C 3/065 450/81
2005/0239369 A1 * 10/2005 Clark ..... A61J 13/00 450/81
2005/0282468 A1 * 12/2005 Davis ..... A41C 3/065 450/81
2006/0030239 A1 * 2/2006 Clark ..... A61J 13/00 450/81
2006/0106329 A1 * 5/2006 Hammer ..... A61F 13/145 602/61
2006/0157065 A1 * 7/2006 Rohrig ..... A61J 13/00 128/890
2007/0073209 A1 * 3/2007 Raj ..... A61F 13/0246 602/42
2008/0014008 A1 * 1/2008 Silver ..... A61K 9/7007 401/6
2008/0039781 A1 * 2/2008 Bjorge ..... A61M 1/062 604/74
2008/0132821 A1 * 6/2008 Propp ..... A61M 25/02 602/54
2008/0287037 A1 * 11/2008 Solberg ..... A61M 1/06 450/36
2009/0149114 A1 * 6/2009 Horton ..... A41C 3/065 450/54

(56) References Cited

U.S. PATENT DOCUMENTS

| | | | | |
|---|---|---|---|---|
| 2009/0166481 | A1* | 7/2009 | Chen | A61J 9/0638 248/102 |
| 2009/0187130 | A1* | 7/2009 | Asmus | A61L 15/46 602/57 |
| 2009/0194116 | A1* | 8/2009 | Pacini | A61J 13/00 128/890 |
| 2009/0283101 | A1* | 11/2009 | Mans | A61J 13/00 128/890 |
| 2009/0286452 | A1* | 11/2009 | Grayson | A41C 3/04 450/36 |
| 2010/0069869 | A1* | 3/2010 | Johnston | A61F 13/141 604/385.02 |
| 2010/0075561 | A1* | 3/2010 | Burrow | B32B 5/08 442/394 |
| 2011/0065360 | A1* | 3/2011 | Francis | A61J 13/00 450/81 |
| 2011/0257574 | A1* | 10/2011 | Svensby | A61F 13/00085 602/57 |
| 2012/0083723 | A1* | 4/2012 | Vitaris | A61F 13/0203 602/43 |
| 2012/0129428 | A1* | 5/2012 | Taylor | A41C 3/04 450/37 |
| 2012/0165730 | A1* | 6/2012 | McCoy | A61J 13/00 604/76 |
| 2014/0141693 | A1* | 5/2014 | Madden | A41C 3/04 450/37 |

* cited by examiner

BREAST ADHESIVE

BACKGROUND OF THE INVENTION

The present invention relates to an adhesive. More specifically, the present invention relates to an adhesive having a perimeter composed of a plurality of curved sections for securing a nipple shield to a breast.

Many women who give birth prefer to naturally breastfeed their child. However, for some women natural breastfeeding can be difficult because of potential problems regarding their nipples' ability to easily allow milk to flow from the breast, or the child may have trouble latching on to the mother's nipple. In these instances, it can be helpful for the mother to use a nipple shield to aid her in breastfeeding. The nipple shield is designed to sit atop the breast, such that a nipple of the nipple shield is aligned with the nipple of the mother's breast; in this way, the nipple shield helps ensure the baby can properly breastfeed from their mother.

However, often the nipple shield can be difficult to keep aligned, as it is necessary for the mother to use one hand to hold the nipple shield and the other to help the baby breastfeed. This can make the mother distracted and detract from the bonding process between the baby and the mother. Additionally, it may also lead to the child losing out on potential nutrients if the nipple shield is poorly aligned. Therefore, there exists a need for an adhesive designed to adhere a nipple shield to a breast, while not obstructing the breastfeeding process.

In light of the devices disclosed in the known art, it is submitted that the present invention substantially diverges in design elements and methods from the known art and consequently it is clear that there is a need in the art for an improvement for a breast adhesive. In this regard the instant invention substantially fulfills these needs.

SUMMARY OF THE INVENTION

In view of the foregoing disadvantages inherent in the known types of breast adhesives now present in the known art, the present invention provides a new breast adhesive wherein the same can be utilized for securing a nipple shield to a breast.

It is an objective of the present invention to provide a breast adhesive a flexible member, having a front side and a rear side, wherein the rear side is configured to adhere to both a breast and a nipple shield simultaneously. The flexible member comprises a U-shape with a first end and a second end disposed opposite one another, such that the first end and the second end are symmetrical about a vertical axis. A plurality of flanges are disposed along an outer perimeter of the flexible member. A gap is formed between each flange and configured to allow independent movement of each flange.

It is another object of the present invention to provide a method for securing a nipple shield to a breast comprising the steps of providing a flexible U-shaped member having a plurality of flanges forming an outer perimeter thereof; adhering an inner perimeter of the flexible member interior to an outer perimeter of the nipple shield and adhering the flanges of the outer perimeter of the flexible member exterior to the outer perimeter of the nipple shield. In this way, the nipple shield is secured to a mother while breastfeeding.

It is therefore an object of the present invention to provide a new and improved breast adhesive that has all of the advantages of the known art and none of the disadvantages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
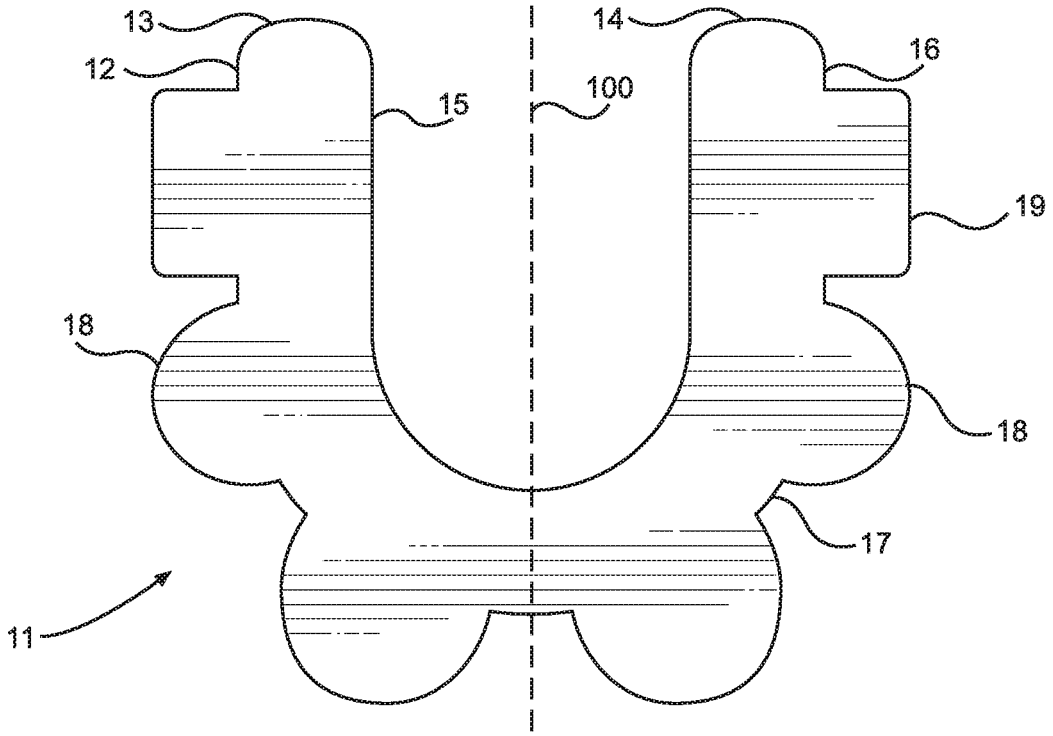
FIG. 1 shows a front view of a first embodiment of the breast adhesive.

Reference is made herein to the attached drawings. Like reference numerals are used throughout the drawings to depict like or similar elements of the breast adhesive. For the purposes of presenting a brief and clear description of the present invention, the preferred embodiment will be discussed as used for securing a nipple shield to a breast. The figures are intended for representative purposes only and should not be considered to be limiting in any respect.

Referring now to FIG. 1, there is shown a front view of a first embodiment of the breast adhesive. The breast adhesive for a nipple shield comprises a flexible member 11 having a front side 12 and a rear side. In the illustrated embodiment, the flexible member 11 has a U-shape with a first end 13 and a second end 14, wherein the first end 13 and the second end 14 are symmetrical about a vertical axis 100. In this way, an apex of the first end 13 and an apex of the second end 14 are aligned with one another in the illustrated embodiment.

The flexible member 11 has an inner perimeter 15 and an outer perimeter 16. The inner perimeter 15 and the outer perimeter 16 are concentric about a common point. In this way, the inner perimeter 15 has an inner radius, as measured from the common point to the inner perimeter 15 and the outer perimeter 16 has an outer radius, as measured from the common point to the outer perimeter 16.

In the illustrated embodiment, a tangent line of the inner perimeter 15 is cotangent to a tangent line of the outer perimeter 16, such that a distance between the inner perimeter 15 and the outer perimeter 16 is consistent between the first end 13 and the second end 14. However, in other embodiments, the distance between the inner perimeter 15 and the outer perimeter 16 may taper inwardly from the vertical axis towards the first end 13 and the second end 14 respectively.

In the illustrated embodiment, a plurality of flanges 18 form the outer perimeter, wherein each flange extends outwardly such that the plurality of flanges 18 extend away from the outer perimeter 16. In this way, the outer perimeter 16 comprises a plurality of flanges. In the shown embodiment, one pair of the flanges 18 includes a wing 19, each wing 19 disposed proximate to the first end 13 and the second end 14, respectively. In the shown embodiment, each wing 19 has a rectangular shape, so as to adhere to the nipple shield effectively.

Additionally, in the shown embodiment, the flanges 18 extend intermittently along the outer perimeter 16, such that each flange 18 is disposed evenly from one another with a gap 17 therebetween. In this way, the flexible member 11 uses each flange 18 as an adhesive point to adhere to the nipple shield to the breast. In the illustrated embodiment, each flange 18 comprises a semi-circular shape, however in other embodiments, each flange 18 comprises a different shape configured to include the gap 17 between a first and second flange 18. The gap 17 formed between each flange is configured to allow for independent movement of each flange. In this way, when the flange is adhered to the breast, if the skin or nipple shield is jostled or moved in any way, the breast adhesive will not pull on a user's skin, preventing pain, discomfort, and irritation to the breast.

In the shown embodiment, the inner perimeter 15 of the flexible member 11 is configured to be positioned interior to an outer perimeter of the nipple shield while the outer perimeter 16 of the flexible member 11 is configured to be positioned exterior to the outer perimeter of the nipple shield. In this way, the inner perimeter overlaps the nipple shield and the flanges of the outer perimeter overlap the breast, thereby aiding in adhering the nipple shield to the breast.

Figure 2:
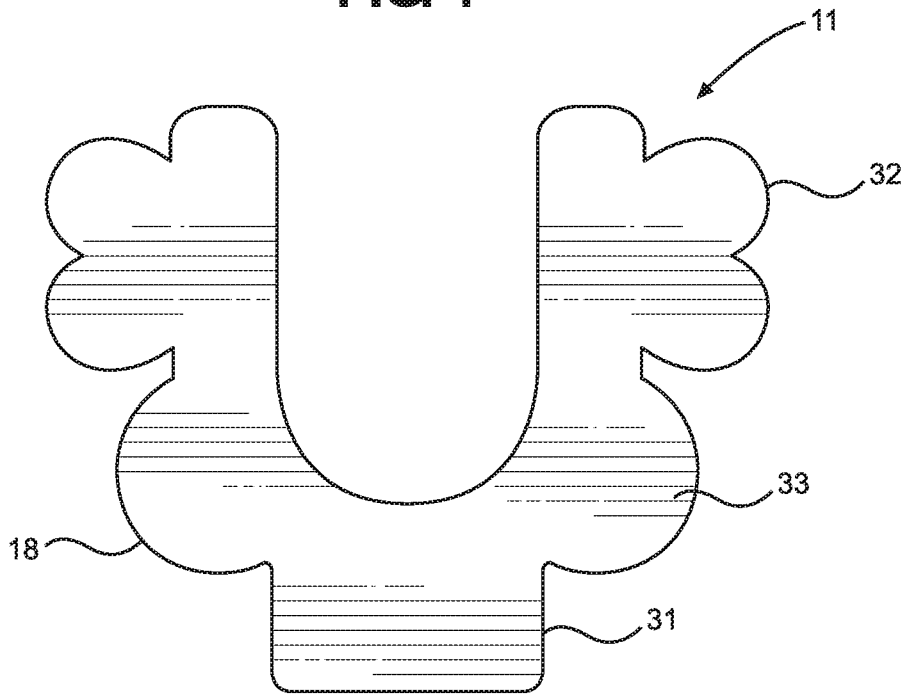
FIG. 2 shows a front view of a second embodiment of the breast adhesive.

Referring now to FIG. 2, there is shown a front view of a second embodiment of the breast adhesive. In some embodiments, a tab 31 is disposed along the nadir of the outer perimeter of the flexible member. The tab 31 is configured to facilitate removal of the breast adhesive after use. In the illustrated embodiment, the tab 31 is rectangular and comprises a width and height great than a width and/or height of a flange 32, 33 extending from the outer perimeter 18. In some embodiments, a rear side of the tab 31 is void of adhesive backing. In this way, the tab 31 is easily lifted from the skin with a pincer grasp or single finger after the mother has finished using her nipple shield.

Figure 3:
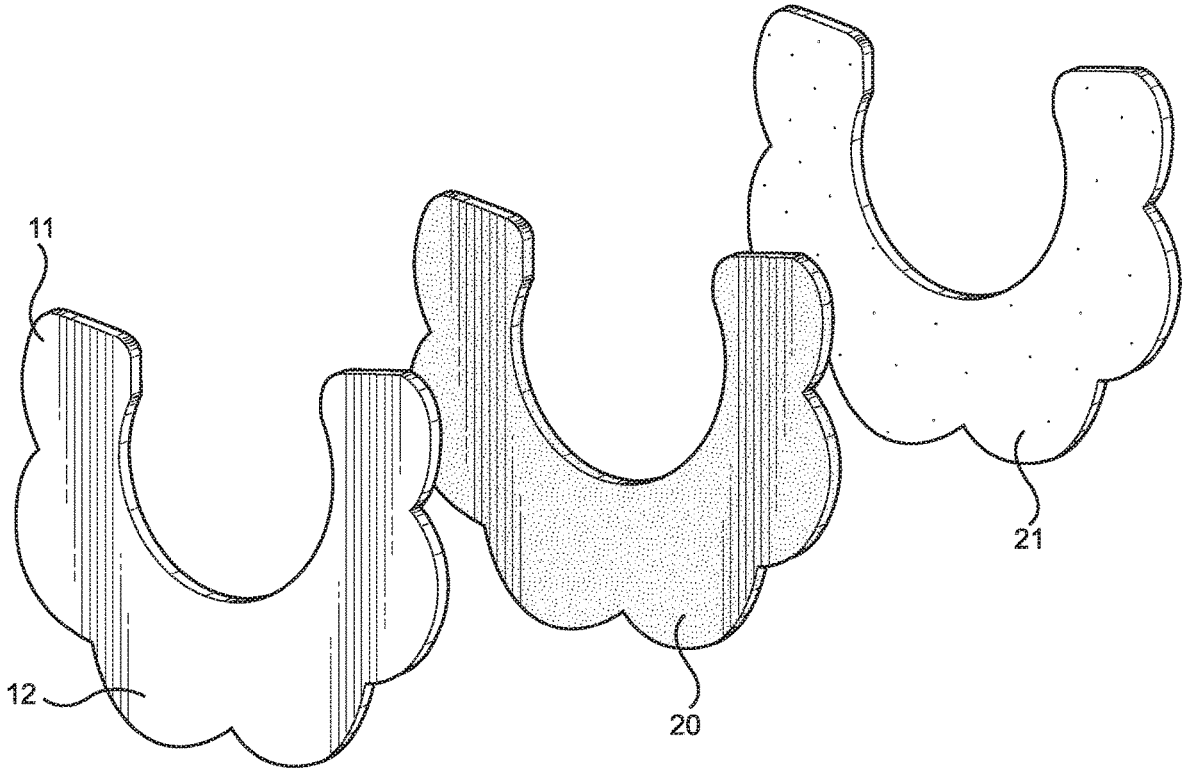
FIG. 3 shows an exploded view of a third embodiment of the breast adhesive.

Referring now to FIG. 3, there is shown an exploded view of a third embodiment of the breast adhesive. In some embodiments, the breast adhesive is composed of a plurality of layers. In the illustrated embodiment, the breast adhesive is composed of three layers, wherein the front side 12 of the flexible member 11 comprises a first layer, forming the topmost layer. In the shown embodiment, a second layer is an adhesive backing 20, wherein the adhesive backing 20 has an adhesive thereon such that it is configured to removably secure to a plurality of objects, such as the nipple shield and the breast. In the illustrated embodiment, the adhesive backing 20 is coextensive with the flexible member, such that the adhesive backing 20 comprises the rear side of the flexible member opposite the front side 12.

In the shown embodiment, a removable backing 21 is removably secured to the adhesive backing 20. In this way, the removable backing 21 can be removed immediately prior to use, thereby ensuring the adhesive on the adhesive backing 20 is preserved until an individual decides to utilize the breast adhesive. In the illustrated embodiment, the removable backing 21 is coextensive with the flexible member. The removable backing 21 comprises a same perimeter outline as the second layer in order to entirely cover the adhesive.

In the shown embodiment, the front side 12 is composed of a waterproof material, such that any liquids disposed thereon do not soak through the flexible member 11 to the nipple shield or breast. Additionally, in the illustrated embodiment, the flexible member is composed a bacteria resistant material, such that bacterial growth in inhibited on the front side 12, the adhesive backing 20, and the removable backing 21.

Figure 4:
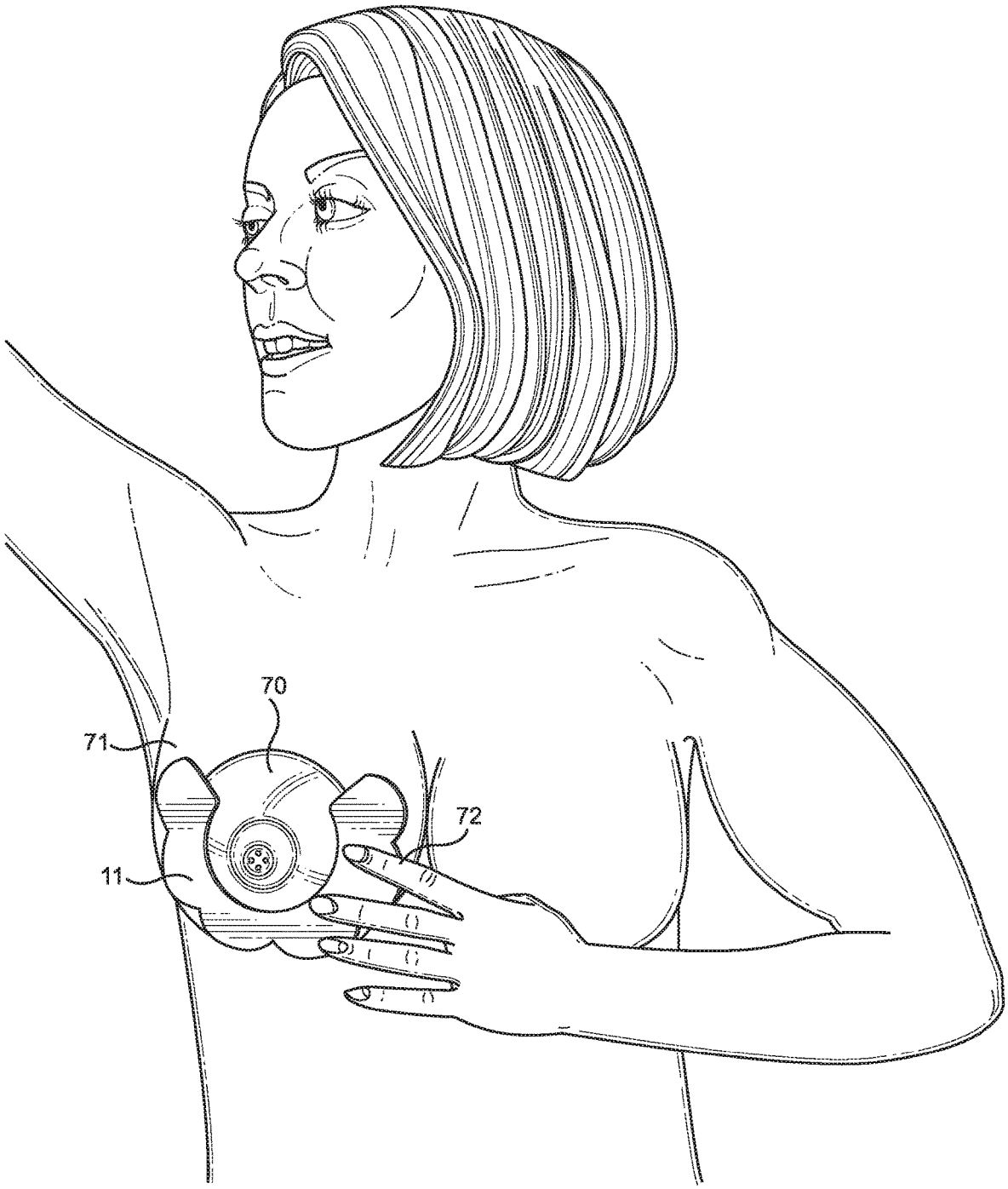
FIG. 4 shows a perspective view of a third embodiment of the breast adhesive in use.

Referring now to FIG. 4, there is shown a perspective view of a third embodiment of the breast adhesive in use. A method of use for the breast adhesive includes placing the nipple shield 70 atop the breast, such that the nipple of the nipple shield is aligned with the nipple of the breast 71. The method of use for the breast adhesive then includes removing the removable backing from the rear side of the flexible member 11, and placing the flexible member 11 atop the nipple shield 70. In this way, the flexible member 11 is disposed such that the inner perimeter of the flexible member 11 is positioned interior to an outer perimeter of the nipple shield 70 and the outer perimeter of the flexible member 11 is positioned exterior to the outer perimeter of the nipple shield 70. The user is then able to use her fingers 71 to press the flanges along the outer perimeter of the flexible member 11 to removably secure the breast adhesive to the nipple shield.

Thus, the user is no longer confined to always use one hand to secure the nipple shield, and can instead use the breast adhesive to prevent the nipple shield from becoming dislodged during use. In this way, she is free to use both hands while nursing her child.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method for attaching a breast adhesive for a nipple shield, comprising:

placing the nipple shield over a breast, such that a nipple of the breast is aligned with a protruding member of the nipple shield;

providing the breast adhesive, the breast adhesive having a flexible U-shaped member having a plurality of flanges extending along an outer perimeter of the flexible member and an adhesive disposed on a rear side of the flexible member;

removing a removable back from the rear side of the flexible member;

aligning a nadir of the breast adhesive with a lowermost edge of the nipple shield, wherein the nadir is disposed opposite to an open end of the U-shaped member; and aligning the breast adhesive with an edge of the nipple shield, such that an inner perimeter of the flexible member is positioned interior to an outer perimeter of the nipple shield and the outer perimeter of the flexible member is positioned on the breast and exterior to the outer perimeter of the nipple shield.

2. The method for attaching a breast adhesive for a nipple shield of claim 1, wherein the inner perimeter and the outer perimeter of the flexible member are concentric about a common point.

3. The method for attaching a breast adhesive for a nipple shield of claim 1, wherein a front side of the flexible member is composed of a waterproof material.

4. The method for attaching a breast adhesive for a nipple shield of claim 1, wherein the flexible member comprises a first end and a second end disposed opposite one another and are symmetrical to one another about a vertical axis.

5. The method for attaching a breast adhesive for a nipple shield of claim 1, wherein each flange comprises a semi-circular shape.

6. The method for attaching a breast adhesive for a nipple shield of claim 1, wherein the plurality of flanges form the entire outer perimeter of the flexible member.

7. The method for attaching a breast adhesive for a nipple shield of claim 1, further comprising positioning the distal ends of the breast adhesive above the nipple of the breast when secured to the nipple shield.

8. A method for attaching a breast adhesive for a nipple shield, comprising:

placing the nipple shield over a breast, such that a nipple of the breast is aligned with a protruding member of the nipple shield;

providing the breast adhesive, the breast adhesive having a flexible U-shaped member having a plurality of flanges extending along an outer perimeter of the flexible member and an adhesive disposed on a rear side of the flexible member, wherein the plurality of flanges form the entire outer perimeter of the flexible member;

removing a removable back from the rear side of the flexible member;

aligning a nadir of the breast adhesive with a lowermost edge of the nipple shield, wherein the nadir is disposed opposite to an open end of the U-shaped member;

aligning the breast adhesive with an edge of the nipple shield, such that an inner perimeter of the flexible member is positioned interior to an outer perimeter of the nipple shield and the outer perimeter of the flexible member is positioned on the breast and exterior to the outer perimeter of the nipple shield; and positioning the distal ends of the breast adhesive above the nipple of the breast when secured to the nipple shield.

* * * * *